US005988490A

United States Patent [19]

Christensen

[11] Patent Number: 5,988,490

[45] Date of Patent: Nov. 23, 1999

[54] ELEVATED BOTTOM CARTON

[75] Inventor: Charles Christensen, Centuria, Wis.

[73] Assignee: Tetra Laval Holdings & Finance, SA, Pully, Switzerland

[21] Appl. No.: 09/052,401

[22] Filed: Mar. 31, 1998

Related U.S. Application Data

[63] Continuation-in-part of application No. 08/955,063, Oct. 21, 1997, Pat. No. 5,845,840.

[51] Int. Cl.[6] ..... B65D 5/00

[52] U.S. Cl. ..... 229/104; 229/184; 229/198.2; 229/915.1

[58] Field of Search ..... 229/198.2, 915.1, 229/104, 137, 125.42, 184

[56] References Cited

U.S. PATENT DOCUMENTS

| | | | |
|---|---|---|---|
| 1,414,236 | 4/1922 | Walmsley | 229/104 |
| 2,142,142 | 1/1939 | Newsom | 229/104 |
| 2,523,251 | 9/1950 | Pantalone et al. | 229/106 |
| 2,815,164 | 12/1957 | Painter | 229/109 |
| 3,236,436 | 2/1966 | Cheeley | 229/137 |
| 3,275,216 | 9/1966 | Collins | 229/108 |
| 3,332,599 | 7/1967 | Jonson | 229/137 |
| 3,402,876 | 9/1968 | Kuchenbecker | 229/106 |
| 3,412,922 | 11/1968 | Miller et al. | 229/184 |
| 3,586,232 | 6/1971 | Scully | 229/104 |
| 3,908,890 | 9/1975 | Baker | 229/137 |
| 4,221,162 | 9/1980 | Kauffman et al. | 493/133 |
| 4,313,556 | 2/1982 | Boyle et al. | 229/108 |
| 4,332,577 | 6/1982 | Mosse | 229/198.2 |
| 4,589,862 | 5/1986 | Murrah | 493/183 |
| 4,601,425 | 7/1986 | Bachner | 229/184 |
| 4,776,830 | 10/1988 | Fujikawa et al. | 493/133 |
| 4,838,847 | 6/1989 | Kume et al. | 493/133 |
| 4,986,058 | 1/1991 | Carlsson et al. | 493/141 |
| 4,990,128 | 2/1991 | Murrah | 493/133 |
| 5,056,707 | 10/1991 | Larsen | 229/137 |
| 5,120,292 | 6/1992 | Ueda et al. | 493/134 |
| 5,152,736 | 10/1992 | Owen et al. | 493/133 |
| 5,167,607 | 12/1992 | Larsen | 493/183 |
| 5,222,667 | 6/1993 | Fujikawa et al. | 229/137 |
| 5,232,146 | 8/1993 | Antonacci | 229/116.1 |
| 5,234,398 | 8/1993 | Larsen | 493/183 |
| 5,265,794 | 11/1993 | Johnston | 229/102 |
| 5,295,941 | 3/1994 | Fujikawa et al. | 493/133 |
| 5,725,144 | 3/1998 | Stone et al. | 229/104 |
| 5,845,840 | 12/1998 | Johansson et al. | 229/104 |

FOREIGN PATENT DOCUMENTS

| | | | |
|---|---|---|---|
| 112553 | 7/1984 | European Pat. Off. | 229/137 |

*Primary Examiner*—Gary E. Elkins
*Attorney, Agent, or Firm*—Welsh & Katz, Ltd.

[57] ABSTRACT

A carton having a primary elevated bottom portion extending along the length of an exposed raw paperboard edge to protect the carton and to prevent moisture absorption. The carton also having a secondary elevated bottom portion substantially within the primary elevated portion and having an elevation greater than the primary elevated bottom portion. Additional elevated portions are provided for additional raw paperboard edges on the bottom of the carton. The present invention alleviates the problem of cartons having soggy bottoms since the point of absorption, the raw paperboard edge, is elevated above the moisture which may be present during distribution from the packaging machine to the retailer. The elevated bottom portion is actually inverted into the carton with planar portions resting on the surface to support the carton.

20 Claims, 3 Drawing Sheets

ELEVATED BOTTOM CARTON

CROSS REFERENCES TO RELATED APPLICATIONS

This is a continuation-in-part application of U.S. patent application Ser. No. 08/955,063 filed on Oct. 21, 1997 now U.S. Pat. No. 5,845,840 which is hereby incorporated by reference.

STATEMENT REGARDING FEDERALLY SPONSORED RESEARCH OR DEVELOPMENT

Not Applicable

BACKGROUND OF THE INVENTION

1. Field of the Invention

The present invention relates to a carton having an elevated bottom. Specifically, the present invention relates to a carton having the edge portions of the bottom elevated to protect the raw paperboard edges from damage and absorption of moisture.

2. Description of the Related Art

Cartons fabricated from a carton blank on a form, fill and seal packaging machine risk absorption of moisture into the raw paperboard edges of the bottom of the carton. This absorption is accelerated if the raw paperboard edges are damaged and the carton is continuously exposed to moisture. The transportation, loading and storage of the carton from the conveyance between the packaging machine/packer unit and the retailer display are all sources for damage and moisture absorption.

The raw paper edges are a by-product of the composition of the carton blank. Generally, the carton blank is cut and scored from a sheet of coated fiberboard material. The coated fiberboard material is usually composed of three layers, and may have a barrier layer juxtaposed between fiberboard layers. The exposed surfaces of this sheet are coated with a polymer material such as polyethylene. However, the coating does not extend to the edges which are thus left uncoated, and partially unprotected at least to moisture and sensitive to damage. When the carton is erected and partially formed, these raw paper edges are most prevalent at the bottom of the carton. If moisture is absorbed into the raw paper edges, the water may be absorbed throughout the fiberboard interior layer, which due to its cellulose-like nature, has a strong affinity for liquids. This absorption of moisture may compromise the integrity of the carton thereby rendering it defective.

This problem has yet to be directly addressed by the packaging industry. However, inventions directed to resolving the stability of cartons have been disclosed in the prior art. Mills et al, U.S. Pat. Nos. 5,482,204, and 5,588,943, respectively for a Carton Bottom Sealer and Carton Bottom Sealing Dies disclose cartons having an embossed inverse pyramidal bottom which is directed to providing greater stability to the filled carton and to reduce bulging of the carton. It should be noted, as shown in FIGS. 8 and 9 of the Mills et al Patents, that the end portions of the exposed raw paper edges of the bottom of the carton are not embossed, and therefore are susceptible to moisture absorption.

Fujikawa et al, U.S. Pat. No. 5,222,667, for a Container Made Of Paper-Base Laminate, similarly discloses a carton having an inverted V-shaped bottom to provide greater stability to the carton. As shown in FIG. 6 of the Fujikawa et at Patent, the raw paper edge of panel 27 is not inverted and is susceptible to moisture absorption since the V-shaped inversion begins at the raw paper edge and since the inversion must be centered to provide stability to the carton.

BRIEF SUMMARY OF THE INVENTION

The present invention resolves the problem of absorption of moisture through raw paper edges by providing a carton having the raw paper edges elevated in order to protect the raw paperboard edges and reduce the susceptibility of moisture absorption. The present invention is able to accomplish this without adversely affecting the carton.

One aspect of the present invention is a carton having bottom panels sealed together to form a sealed bottom with the edge of one bottom panel exposed wherein a region surrounding the edge is elevated to prevent moisture absorption.

Another aspect of the present invention is a carton having bottom panels sealed together to form a sealed bottom with a plurality of raw paper edges exposed wherein all of the raw paper edges are elevated to prevent moisture absorption.

It is a primary object of the present invention to provide a carton having elevated raw paper edges on the bottom of the carton to prevent moisture absorption.

It is a further object of the present invention to provide a carton having all raw paper edges on the bottom of the carton elevated in order to prevent moisture absorption.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of one embodiment of a carton of the present invention.

Figure 1:
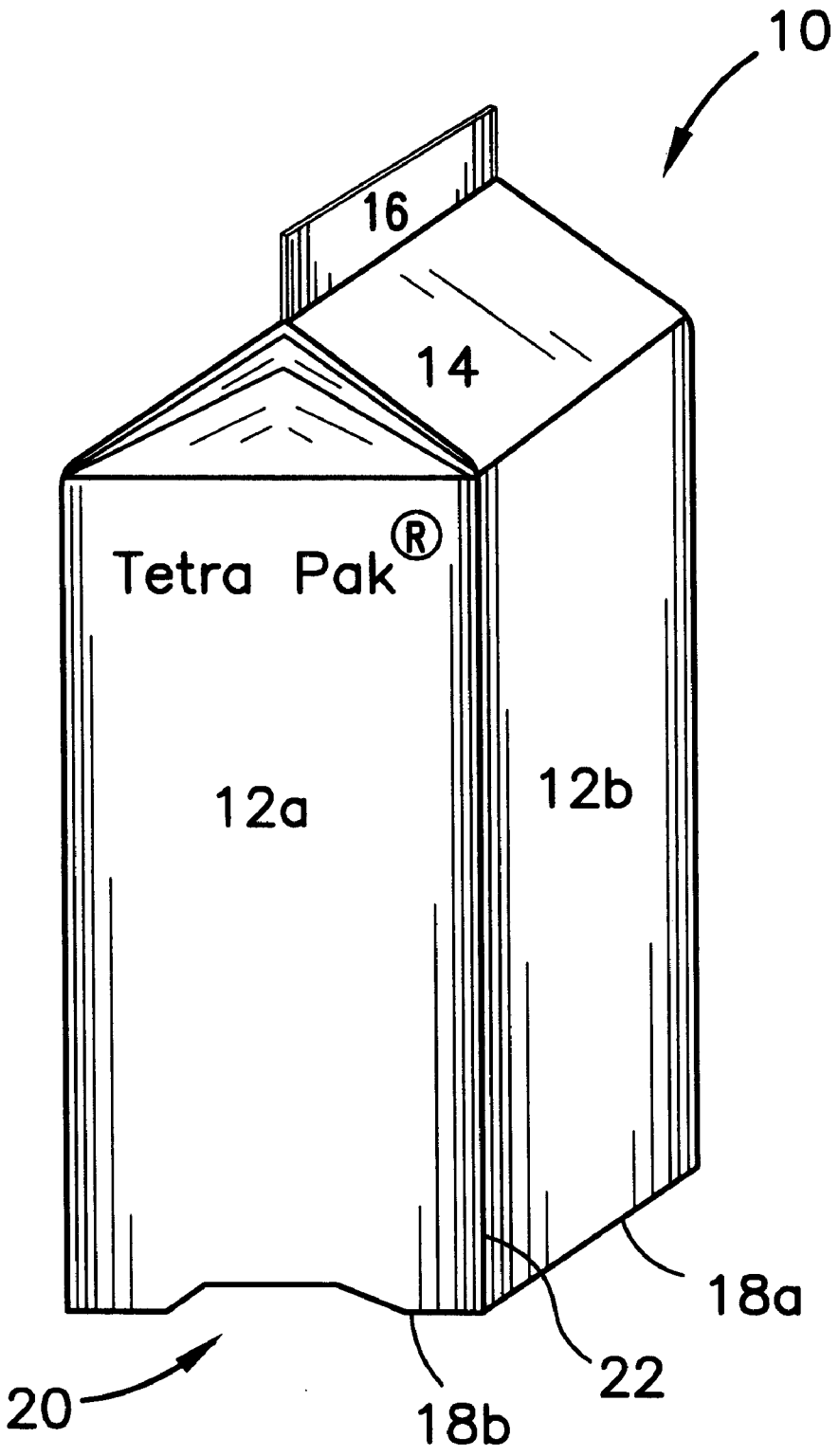
Figure 2:
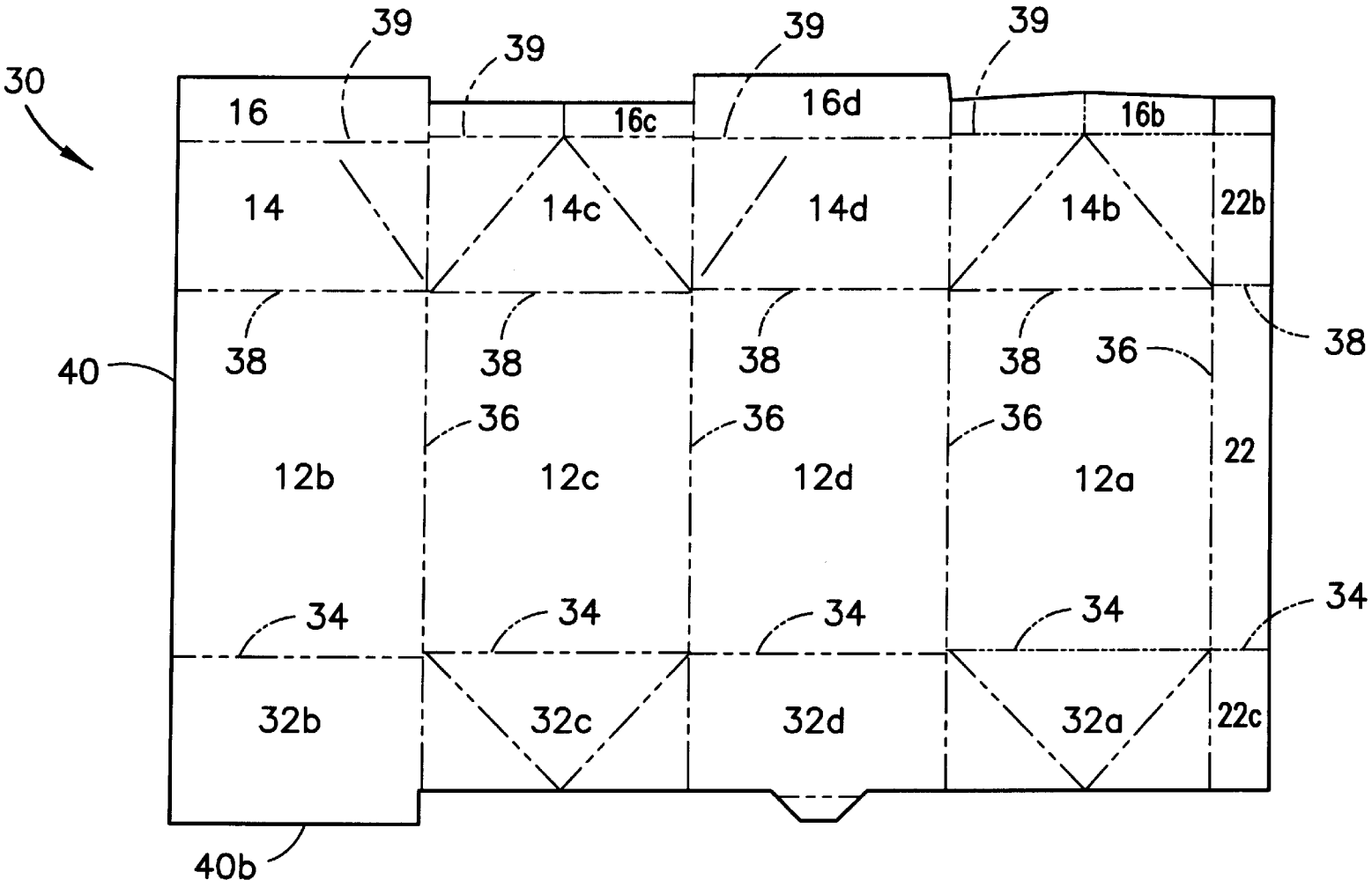

There is illustrated in FIG. 2 a plan view of a blank for the carton of FIG. 1.

Figure 3:
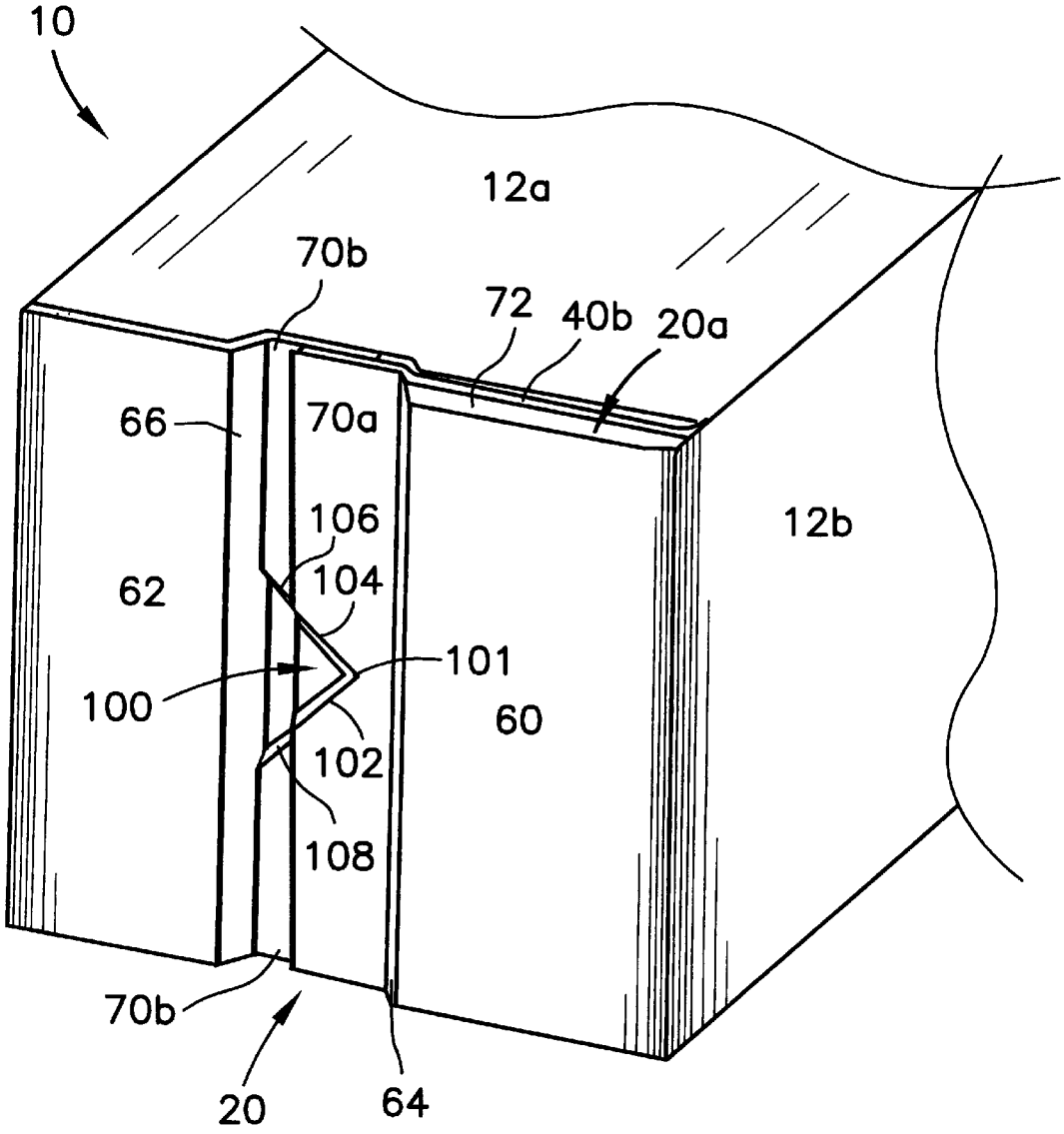

There is illustrated in FIG. 3 bottom perspective view of one embodiment of a carton of the present invention.

DETAILED DESCRIPTION OF THE INVENTION

There is illustrated in FIG. 1 a carton 10 embodying the present invention. The carton 10 has a plurality of side panels 12*a* and 12*b*, a top panel 14, a top fin 16, bottom score lines 18*a* and 18*b* defining the bottom from the side panels 12*a* and 12*b*, and an elevated portion 20. The side panel 12*b* is actually folded over and sealed to a sealing panel 22. The folding and sealing of the carton creates a raw paper edge which extends from the top 16 to the bottom of the carton 10 along this intersection of the sealing panel 22 and side panel 12*b*, top panel 14, top fin 16 and the bottom panel corresponding to side panel 12*b*.

FIG. 2 illustrates a blank 30 of the carton 10 of FIG. 1. The side panels 12*a–d* are separated from bottom panels 32*a–d* by bottom horizontal score lines 34 and each of the side panels 12*a–d* and bottom panels 32*a–d* are separated from each other by vertical score lines 36. The side panels 12*a–d* are separated from top panels 14 and 14*b–d* by top horizontal score lines 38. The top fin panels 16 and 16*b–d* are separated from top panels 14 and 14*b–d* by upper horizontal score line 39. The sealing panel 22 is separated from side panel 12*a* by a vertical score line 36. A top sealing panel 22*b* and a bottom sealing panel 22*c* further define sealing panel 22. The raw paper edge 40 extends along top fin 16, top panel 14, side panel 12*b* and bottom panel 32*b*.

FIG. 3 shows a preferred embodiment of the present invention. The bottom of the carton 10 has the elevated portion 20 bounded by substantially planar portions 60 and 62. The planar portions 60 and 62 are substantially perpendicular to side panels 12*a*, 12*b* and 12*c* and 12*d*, not shown. The planar portions 60 and 62 contact the conveyor belt 54 while elevated portion 20 is elevated above the belt 54 and any moisture thereon. The same applies during distribution whether in a crate or a shelf at a store.

The elevated portion 20 is further defined by angled portions 64 and 66 and elevated planar portion 70. The elevated planar portion 70 is further defined as elevated planar portion 70*a* and elevated planar portion 70*b*. The elevated planar portion 70*a* substantially includes a portion of panel 32*b* while elevated planar portion 70*b* includes a portion of panel 32*d*. The exposed raw paper edge 40*a* traverses the bottom of the carton 10, extending from the end of panel 12*a* to the end of panel 12*c*, not shown. Likewise, the elevated portion 20 traverses the bottom of the carton 10. Preferably, elevated portion 20 is centered on the bottom of the carton 10 with planar portions 60 and 62 being equal in area to each other. However, those skilled in the pertinent art will recognize that planar portions 60 and 62 may be unequal and elevated portion 20 may be uncentered without departing from the scope and spirit of the present invention.

It is readily apparent that elevated portion 70*a*, angled portion 64 and planar portion 60 all are part of bottom panel 32*b*. Also, elevated portion 70*b*, angled portion 66 and planar portion 62 all are part of bottom panel 32*d*.

The exposed edge 40*b* is substantially perpendicular to exposed edge 40*a*. A side elevated portion 20*a* elevates this exposed edge 40*b* thereby preventing moisture absorption as with exposed edge 40*a*. The side elevated portion 20*a* has an angled portion 72 which engages planar portion 60, side panel 12*a*, and angled portion 64. Those skilled in the art will recognize that the exposed raw edges may be elevated in a similar fashion without departing from the scope and content of the present invention.

Approximately in the center of the elevated portion 20 is a secondary elevated portion 100. The secondary elevated portion 100 prevents loss of elevation in the center of the bottom of the carton 10 during transportation from a packaging machine to the retailer/wholesaler to the consumer. As is apparent, the center of the bottom of the carton 10 is most susceptible to deelevation from the weight of the product. The weight of the product in the carton 10 is focused on the center of the bottom of the carton 10, and thus it is necessary to provide greater elevation in this area. This greater elevation is provided by the secondary elevated portion 100 which compensates for gravitational forces exerted by the product on the center of the bottom of the carton 10.

In a preferred embodiment, the secondary elevated portion 100 is triangular in shape with its apex 101 near the exact center of the bottom of the carton 10. The secondary elevated portion 100 is substantially contained within elevated planar portions 70*a* and 70*b*. However, there is a transition to angled portion 66. Alternatively, the triangular shaped embodiment of the secondary elevated portion 100 may be rotated any degree from 1–360 degrees, about apex 101 while not departing from the scope and spirit of the present invention. Thus, the secondary elevated portion 100 may lie entirely within elevated planar portion 70*a*.

In the preferred embodiment, the secondary elevated portion 100 is partially defined by secondary angled portions 102, 104, 106 and 108. The secondary angled portions 102 and 104 form a transition from the secondary elevated portion 100 to elevated planar portion 70*a* whereas the secondary angled portions 106 and 108 form a transition from the secondary elevated portion 100 to elevated planar portion 70*b*.

The bottom of the carton 10 is usually formed on a mandrel of a form, fill and seal packaging machine, not shown. The carton blanks 30 are fed from a magazine, not shown, to a bottom forming station of the machine, not shown. During the transfer from magazine to bottom forming station, the carton blank is erected. On the bottom forming station, the bottom panels are pretreated if necessary, and then heat sealed together to form the bottom. This is accomplished by pressing against the bottom panels as they lie on the mandrel. In order to achieve the elevated bottom of the present invention, one may have a special press and mandrel which allows for the elevated bottom of the present invention.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

I claim as my invention:

1. A carton having a plurality of side panels, the plurality of side panels including at least a first pair of opposing side panels and a second pair of opposing side panels generally perpendicular to the first pair of opposing side panels, and a plurality of bottom panels, each bottom panel corresponding to an adjacent side panel, the plurality of bottom panels being folded and sealed together to form a sealed carton bottom, a last folded and sealed bottom panel having an exposed edge traversing the bottom of the carton, the carton comprising:

a primary elevated portion extending along a length of the exposed edge between the first pair of opposing side panels and generally parallel to the second pair of opposing side panels, the primary elevated portion being inverted into the carton and having an elevation;

a first substantially planar portion defined by one side of the primary elevated portion, the first pair of opposing side panels and one of the second pair of opposing side panels;

a second substantially planar portion defined by an other side of the elevated portion, the first pair of opposing side panels and an other of the second pair of side panels; and a secondary elevated portion disposed within the primary elevated portion, the secondary elevated portion having an elevation greater than the elevation of the primary elevated portion.

2. The carton according to claim 1 wherein the primary elevated portion further comprises a first angled portion engaging the first substantially planar portion, and a second angled portion engaging the second substantially planar portion.

3. The carton according to claim 2 wherein the primary elevated portion further comprises an elevated planar portion engaging the first and second angled portions, the primary elevated planar portion lying on a plane inverted into the carton.

4. The carton according to claim 1 wherein the first and second substantially planar portions are substantially equal in area.

5. The carton according to claim 1 wherein the exposed edge is not at a the center of the elevated portion.

6. The carton according to claim 1 wherein the secondary elevated portion is triangular in shape.

7. The carton according to claim 1 further comprising a plurality of secondary angled portions forming a transition from the secondary elevated portion to the primary elevated portion.

8. The carton according to claim 1 wherein the secondary elevated portion is formed at a center of the bottom of the carton.

9. A carton having a plurality of side panels, the plurality of side panels including at least a first pair of opposing side panels and a second pair of opposing side panels generally perpendicular to the first pair of opposing side panels, and a plurality of bottom panels, each bottom panel corresponding to an adjacent side panel, the plurality of bottom panels being folded and sealed together to form a sealed carton bottom, a last folded and sealed bottom panel having a first exposed edge traversing the bottom of the carton and a second exposed edge substantially perpendicular to the first exposed edge, the carton comprising:

a primary elevated portion extending along a length of the first exposed edge between the first pair of opposing side panels and generally parallel to the second pair of opposing side panels, the primary elevated portion being inverted into the carton and having an elevation;

a side elevated portion extending along a length of the second exposed edge, the side elevated portion being inverted into the carton and having an elevation;

a first substantially planar portion defined by one side of the primary elevated portion, the first pair of opposing side panels and one of the second pair of opposing side panels;

a second substantially planar portion defined by an other side of the primary elevated portion, the first pair of opposing side panels and an other of the second pair of opposing side panels and a secondary elevated portion disposed within the primary elevated portion, the secondary elevated portion having an elevation greater than the elevation of the primary elevated portion.

10. The carton according to claim 9 wherein the primary elevated portion further comprises a first angled portion engaging the first substantially planar portion, and a second angled portion engaging the second substantially planar portion.

11. The carton according to claim 9 wherein the secondary elevated portion is triangular in shape.

12. The carton according to claim 9 further comprising a plurality of secondary angled portions forming a transition from the secondary elevated portion to the primary elevated portion.

13. The carton according to claim 9 wherein the secondary elevated portion is formed at a center of the bottom of the carton.

14. The carton according to claim 10 wherein the primary elevated portion further comprises an elevated planar portion engaging the first and second angled portions, the primary elevated planar portion lying on a plane inverted into the carton.

15. The carton according to claim 9 wherein the first and second substantially planar portions are substantially equal in area.

16. The carton according to claim 10 wherein the side elevated portion engages the second angled portion.

17. A carton having a plurality of side panels, the plurality of side panels including at least a first pair of opposing side panels and a second pair of opposing side panels generally perpendicular to the first pair of opposing side panels, and a plurality of bottom panels, each bottom panel corresponding to an adjacent side panel, the plurality of bottom panels being folded and sealed together to form a sealed carton bottom, the last folded and sealed bottom panel having a plurality of exposed edges, the carton comprising:

a plurality of primary elevated portions, each of the plurality of primary elevated portions corresponding to an associated one of the exposed edges, each of the primary elevated portions having an elevation; and a secondary elevated portion disposed within the one of the plurality of primary elevated portions, the secondary elevated portion having an elevation greater than the elevation of the primary elevated portion within which it is disposed.

18. The carton according to claim 17 wherein the secondary elevated portion is triangular in shape.

19. The carton according to claim 17 further comprising a plurality of secondary angled portions forming a transition from the secondary elevated portion to the primary elevated portion.

20. The carton according to claim 17 wherein the secondary elevated portion is in the center of the bottom of the carton.

* * * * *